United States Patent [19]

Daubendiek et al.

[11] Patent Number: 4,693,964

[45] Date of Patent: Sep. 15, 1987

[54] MULTICOLOR PHOTOGRAPHIC ELEMENT WITH A TABULAR GRAIN EMULSION LAYER OVERLYING A MINUS BLUE RECORDING EMULSION LAYER

[75] Inventors: Richard L. Daubendiek, Rochester; Gary L. House, Victor; Timothy R. Gersey, Rochester, all of N.Y.

[73] Assignee: Eastman Kodak Company, Rochester, N.Y.

[21] Appl. No.: 891,803

[22] Filed: Aug. 1, 1986

Related U.S. Application Data

[63] Continuation-in-part of Ser. No. 790,692, Oct. 23, 1985, abandoned.

[51] Int. Cl.[4] ..... G03C 1/40; G03C 7/26

[52] U.S. Cl. ..... 430/505; 430/567; 430/568

[58] Field of Search ..... 430/505, 567, 568, 569

[56] References Cited

U.S. PATENT DOCUMENTS

| | | | |
|---|---|---|---|
| 3,402,046 | 9/1968 | Zwick | 430/504 |
| 3,989,527 | 11/1976 | Locker et al. | 430/434 |
| 4,229,525 | 10/1980 | Ueda | 430/568 |
| 4,433,048 | 2/1984 | Solberg et al. | 430/434 |
| 4,434,226 | 2/1984 | Wilgus et al. | 430/567 |
| 4,435,499 | 3/1984 | Reeves | 430/619 |
| 4,435,501 | 3/1984 | Maskasky | 430/434 |
| 4,439,520 | 3/1984 | Kofron et al. | 430/567 |
| 4,478,929 | 10/1984 | Jones et al. | 430/217 |

OTHER PUBLICATIONS

Allowed U.S. application Ser. No. 891,804, Daubendiek et al, filed 8/1/86.

Berry, "Turbidity of Monodisperse Suspensions of AgBr", Journal of the Optical Society of America, vol. 52, No. 8, Aug., 1962, pp. 888–895.

Research Disclosure, vol. 225, Jan. 1983, Item 22534, pp. 20–58, "Sensitized High Aspect Ratio Silver Halide Emulsions and Photographic Elements".

Research Disclosure, vol. 253, May 1985, Item 25330, pp. 237–240, "Correlating Optical Properties and Tabular Grain Thicknesses to Optimize Photographic Performance".

*Primary Examiner*—Richard L. Schilling

[57] ABSTRACT

Moderate camera speed photographic elements for producing subtractive primary dye images are disclosed, including one emulsion layer comprised of silver bromide or bromoiodide grains having a mean diameter in the range of from 0.4 to 0.55 μm including tubular grains having an aspect ratio of greater than 8:1 accounting for at least 50 percent of the total projected area of the grains in the emulsion layer and being positioned to receive imaging radiation prior to one or more emulsion layers sensitized to the red or green portion of the spectrum. Enhancement of speed-granularity relationships, blue to minus blue speed separation, silver utilization, and image sharpness can all be realized.

10 Claims, 1 Drawing Figure

MULTICOLOR PHOTOGRAPHIC ELEMENT WITH A TABULAR GRAIN EMULSION LAYER OVERLYING A MINUS BLUE RECORDING EMULSION LAYER

This is a continuation-in-part of U.S. Ser. No. 790,692, filed Oct. 23, 1985, now abandoned.

FIELD OF THE INVENTION

This invention relates to camera speed photographic elements capable of producing multicolor images and to processes for their use.

BACKGROUND OF THE INVENTION

Kofron et al U.S. Pat. No. 4,439,520 discloses that multicolor photographic elements of improved speed-granularity relationship, minus blue to blue speed separation, and sharpness can be achieved by employing in one or more of the image recording layers a chemically and spectrally sensitized high aspect ratio tabular grain silver bromide or bromoiodide emulsion. In such an emulsion at least 50 percent of the total projected area of the grains is provided by tabular grains having a thickness of less than 0.3 μm, a diameter of at least 0.6 μm, and an average aspect ratio greater than 8:1. Kofron et al indicates that preferred high aspect ratio tabular grain emulsions are those having an average diameter of at least 1.0 μm, most preferably at least 2.0 μm. Kofron et al states that both improved speed and sharpness are attainable as average grain diameters are increased.

While the high aspect ratio tabular grain emulsions disclosed by Kofron et al produce excellent multicolor photographic elements of higher photographic speeds, it is for some photographic uses more desirable to reduce granularity to minimal levels. Within limits granularity can be reduced by simply coating more silver halide grains per unit area, referred to as increasing silver coverages. Unfortunately, this results in loss of image sharpness and inefficient use of silver. Holding the silver coverage constant, it is conventional practice to improve granularity by reducing mean grain size. Photographic speed is reduced as a direct function of reduced grain size.

While Kofron et al is aware that granularity can be improved at the expense of photographic speed, there is a bias in the art against reducing the mean diameter of tabular grain emulsions to an extent sufficient to optimize granularity for photographic elements of moderate and lower camera speeds. First, the Kofron et al teaching of tabular grain diameters of at least 0.6 μm is not compatible with efficient use of silver at moderate and lower camera speeds. Second, in suggesting that sharpness increases with increasing grain diameters in high aspect tabular grain emulsions, Kofron et al necessarily suggests that reducing grain diameters in these emulsions will reduce sharpness.

The art has long recognized that visible light is more highly scattered by smaller silver halide grain diameters. Berry, "Turbidity of Monodisperse Suspensions of AgBr", *Journal of the Optical Society of America,* Vol. 52, No. 8, August 1962, pp. 888–895, examined monodisperse silver bromide emulsions of mean grain sizes in the range of from 0.1 to 1.0 μm at wavelengths of from 300 to 700 nm and found general agreement with theoretical predictions of light scattering. Ueda U.S. Pat. No. 4,229,525 states that when silver halide grain diameters approximate the wavelength of exposing radiation, increased scattering of light by the grains occurs with concomittant losses in sharpness. Locker et al U.S. Pat. No. 3,989,527 states that silver halide grains having a diameter of 0.2 μm exhibit maximum scattering of 400 nm light while silver halide grains having a diameter of 0.6 μm exhibit maximum scattering of 700 nm light. From interpolation of Locker et al it is suggested that silver halide grains in the range of from 0.4 to 0.55 μm in diameter exhibit maximum scattering of light of from about 550 to 650 nm. Thus, the suggestion by Kofron et al of tabular grains of at least 0.6 μm in diameter avoids what are generally recognized to be grain sizes of maximum light scatter in the minus blue portion of the visible spectrum—that is, the green and red portions of the visible spectrum.

There is precedent in the art for taking the known light scattering properties of silver halide grains into account in selecting grain sizes for multicolor photographic elements. Zwick U.S. Pat. No. 3,402,046 discusses obtaining crisp, sharp images in a green sensitive emulsion layer of a multicolor photographic element. The green sensitive emulsion layer lies beneath a blue sensitive emulsion layer, and this relationship accounts for a loss in sharpness attributable to the green sensitive emulsion layer. Zwick reduces light scattering by employing in the overlying blue sensitive emulsion layer silver halide grains which are at least 0.7 μm, preferably 0.7 to 1.5 μm, in average diameter.

Wilgus et al U.S. Pat. No. 4,434,226; Solberg et al U.S. Pat. No. 4,433,048; Jones et al U.S. Pat. No. 4,478,929; Maskasky U.S. Pat. No. 4,435,501; and *Research Disclosure,* Vol. 225, January 1983, Item 22534, are considered cumulative with the teachings of Kofron et al. The optical transmission and reflection of tabular grain emulsions as a function of tabular grain thicknesses in the range of from 0.07 to 0.16 μm is described in *Research Disclosure,* Vol. 253, May 1985, Item 25330. *Research Disclosure* is published by Kenneth Mason Publications, Ltd., Emsworth, Hampshire P010 7DD, England.

Tabular grain emulsions having mean grain diameters of less than 0.55 μm are known in the art. Such tabular grain emulsions have not, however, exhibited high aspect ratios, since achieving high aspect ratios at a mean grain diameter of less than 0.55 μm requires exceedingly thin grains, less than 0.07 μm in thickness. Typically tabular grains of smaller mean diameter are relatively thick and of low average aspect ratios. A notable exception is Reeves U.S. Pat. No. 4,435,499, which discloses the use of thin (less than 0.3 μm in thickness) tabular grain emulsions in photothermography. Preferred tabular grain emulsions are disclosed to have average grain thicknesses in the range of from 0.03 to 0.07 μm and to have average aspect ratios in the range of from 5:1 to 15:1.

A tabular grain emulsion exhibiting a mean diameter of less than 0.55 μm known to have been incorporated in a multicolor photographic element is Emulsion TC16, reported and compared in the examples below. Emulsion TC16 exhibits a mean grain diameter of 0.32 μm, a mean grain thickness of 0.06 μm, and an average tabular grain aspect ratio of 5.5:1. Emulsion TC16 has been employed in a blue recording yellow dye image providing layer unit overlying green and red recording dye image provide layer units. In the blue recording layer unit in addition to Emulsion TC16 was an overlying high aspect ratio tabular grain emulsion layer having a mean tabular grain diameter of 0.64 μm, satisfying the requirements of Kofron et al, and, over these emulsion layers, a still faster blue recording emulsion comprised of tabular grains having a mean tabular grain diameter of 1.5 μm also satisfying the requirements of Kofron et al.

Daubendiek et al U.S. Ser. No. 790,693, filed Oct. 23, 1985, now abandoned in favor of continuation-in-part U.S. Ser. No. 891,804, filed Aug. 1, 1986, discloses a layer order arrangement in which at least one reduced diameter high aspect ratio tabular grain emulsion layer comprised of silver bromide or bromoiodide grains having a mean diameter in the range of from 0.2 to 0.55 μm including tabular grains having an aspect ratio of greater than 8:1 accounting for at least 50 percent of the total projected area of the grains overlies a blue recording emulsion layer.

SUMMARY OF THE INVENTION

This invention has as its purpose to provide moderate camera speed photographic elements capable of forming superimposed subtractive primary dye images to produce multicolor images of exceptionally high levels of sharpness, particularly in minus blue recording emulsion layers, and exceptionally low levels of granularity. Further it is intended to provide such a photographic element that is highly efficient in its utilization of silver and that exhibits a high elective preference for recording minus blue light exposures in emulsion layers other than blue recording emulsion layers. In other words, it is intended to provide photographic elements which make possible multicolor photographic images that set a new standard of photographic excellence for moderate camera speed photographic applications.

In one aspect this invention is directed to a photographic element for producing multicolor dye images comprised of a support and, coated on the support, superimposed dye image providing layer units comprised of at least one blue recording yellow dye image providing layer unit and at least two minus blue recording layer units including a green recording magenta dye image providing layer unit and a red recording cyan dye image providing layer unit. One of the layer units is positioned to receive imagewise exposing radiation prior to at least one of the minus blue recording layer units and contains a reduced diameter high aspect ratio tabular grain emulsion comprised of a dispersing medium and silver bromide or bromoiodide grains having a mean diameter in the range of from 0.4 to 0.55 μm including tabular grains having an average aspect ratio of greater than 8:1 accounting for at least 50 percent of the total projected area of said grains in said emulsion.

DESCRIPTION OF PREFERRED EMBODIMENTS

Figure 1:
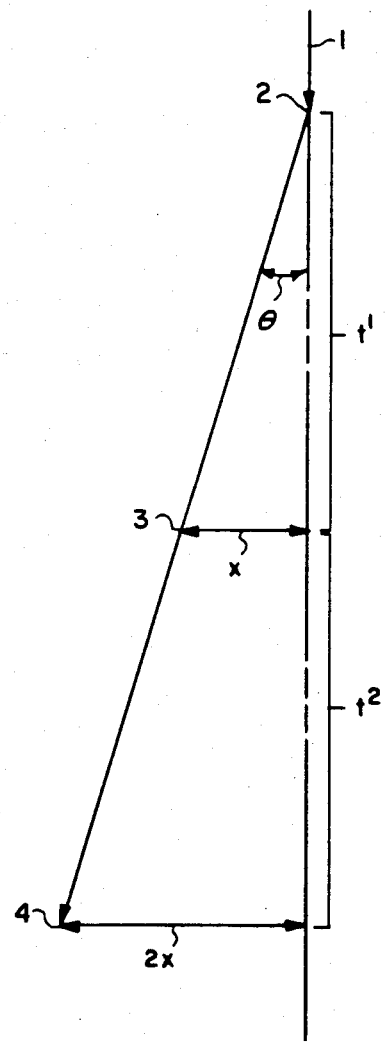
FIG. 1 is a schematic diagram illustrating scattering.

The present invention is directed to multicolor photographic elements containing at least three superimposed due image providing layer units. These dye image providing layer units include at least one blue recording layer unit capable of providing a yellow dye image and at least two minus blue recording layer units including at least one green recording layer unit capable of providing a magenta dye image and at least one red recording layer unit capable of providing a cyan dye image. At least one of the layer units is positioned to receive and transmit to an underlying minus blue recording layer unit imagewise exposing radiation. The overlying layer unit is hereinafter referred to as the causer layer unit while the underlying minus blue recording layer unit is referred to as the affected layer unit.

Since the affected layer unit is dependent upon light transmitted through the causer layer unit for imagewise exposure, it is apparent that sharpness of the dye image produced by the affected layer unit is dependent upon the ability of the causer layer unit to specularly transmit minus blue light the affected layer is intended to record.

In the present invention the objective of minus blue light transmission with minimum scattering or turbidity is achieved by incorporating in the causer layer a reduced diameter high aspect ratio tabular grain emulsion layer. The term "reduced diameter high aspect ratio tabular grain emulsion" is herein employed to indicate an emulsion comprised of a dispersing medium and silver halide grains having a mean diameter in the range of from 0.4 to 0.55 μm including tabular grains having an average aspect ratio of greater than 8:1 accounting for at least 50 percent of the total projected area of grains in the emulsion.

The sharpness of transmitted minus blue light is enhanced by increasing the proportion of the total grain projected area accounted for by tabular grains and increasing the average aspect ratios of the tabular grains. The tabular grains having an aspect ratio greater than 8:1 preferably account for greater than 70 percent of the total grain projected area and, optimally account for greater than 90 percent of total grain projected area. In progressively more advantageous forms of the invention the 50 percent, 70 percent, and 90 percent grain projected area criteria are satisfied by tabular grains having an average aspect ratio of at least 12:1 and up to 20:1, preferably up to 50:1, or optimally up to the highest attainable aspect ratios for the indicated 0.4 to 0.55 μm mean grain diameter range.

The reduced diameter high aspect ratio tabular grain emulsions employed in the practice of the present invention are silver bromide emulsions, preferably containing a minor amount of iodide. The iodide content is not critical to the practice of the invention and can be varied within conventional ranges. While iodide concentrations up to the solubility limit of iodide in silver bromide at the temperature of grain formation are possible, iodide concentrations are typically less than 20 mole percent. Even very low levels of iodide—e.g., as low as 0.05 mole percent—can produce beneficial photographic effects. Commonly employed, preferred iodide concentrations range from about 0.1 mole percent up to about 15 percent.

The preparation of reduced diameter high aspect ratio tabular grain silver bromide or bromoiodide emulsions employed in the practice of this invention is much more difficult to achieve than the preparation of high aspect ratio tabular grain emulsions of larger mean diameters. The double jet precipitation technique described below in Example 1 has been found to produce reduced diameter high aspect ratio tabular grain silver bromoiodide emulsions satisfying the requirements of this invention. Since tabular grains are more easily formed in the absence of iodide, preparation of reduced diameter high aspect ratio tabular grain silver bromide emulsions satisfying the requirements of this invention can be prepared merely by omitting the introduction of iodide during precipitation. The key to successfully precipitating reduced diameter high aspect ratio tabular grains emulsions lies in the nucleation—that is, the initial formation of the grains. Once this has been accomplished, differing mean grain diameters in the range of from 0.4 to 0.55 μm can be achieved by varying run times. Once the basic precipitation procedure is appreciated, adjustment of other preparation parameters can, if desired, be undertaken by routine optimization techniques.

It is a surprising feature of the present invention that the presence of a reduced diameter high aspect ratio tabular grain emulsion in the causer layer unit produces much higher levels of sharpness in the affected layer than can be realized by employing alternatively in the causer layer unit emulsions of the same mean grain size, but otherwise failing to satisfy the reduced diameter high aspect ratio emulsion grain criteria. In other words, the substitution of grains of the same mean grain size which are either nontabular or tabular, but of lower aspect ratio, markedly increases scatter of minus blue light—i.e., green light in the 500 to 600 nm wavelength range and red light in the 600 nm to 700 nm wavelength range.

However, before comparing the scattering properties of emulsions, it is important that the phenomenon of light scattering in photographic elements be itself appreciated. Loss of image sharpness resulting from light scattering generally increases with the distance light travels after being deflected by a grain before being absorbed by another grain. The reason for this can be appreciated by reference to FIG. 1. If a photon of light 1 is deflected by a silver halide grain at a point 2 by an angle $\theta$ measured as a declination from its original path and is thereafter absorbed by a second silver halide grain at a point 3 after traversing a thickness $t^1$ of the emulsion layer, the photographic record of the photon is displaced laterally by a distance x. If, instead of being absorbed within a thickness $t^1$, the photon traverses a second equal thickness $t^2$ and is absorbed at a point 4, the photographic record of the photon is displaced laterally by twice the distance x. It is therefore apparent that the greater the thickness displacement of the silver halide grains in a photographic element, the greater the risk of reduction in image sharpness attributable to light scattering. (Although FIG. 1 illustrates the principle in a very simple situation, it is appreciated that in actual practice a photon is typically reflected from several gains before actually being absorbed and statistical methods are required to predict its probable ultimate point of absorption.)

In multicolor photographic elements containing three or more superimposed dye image providing layer units an increased risk of reduction in image sharpness can be presented, since the silver halide grains are distributed over at least three layer thicknesses. In some applications thickness displacement of the silver halide grains is further increased by the presence of additional materials that either (1) increase the thicknesses of the emulsion layers themselves—as where dye image providing materials, for example, are incorporated in the emulsion layers or (2) form additional layers separating the silver halide emulsion layers, thereby increasing their thickness displacement—as where separate scavenger and dye image providing material layers separate adjacent emulsion layers. Thus, there is a substantial opportunity for loss of image sharpness attributable to scattering. Because of the cumulative scattering of overlying silver halide emulsion layers, the emulsion layers farther removed from the exposing radiation source can exhibit very significant reductions in sharpness.

If light is deflected in the causer layer unit and thereafter absorbed in the same causer layer unit, some loss in sharpness can be expected, but the absolute value for thin emulsion layers may be too small to be quantified. However, if the deflected light moves from the causer layer unit to the underlying affected layer unit before absorption, a much larger degradation of sharpness occurs.

From the foregoing it is apparent that by providing in an overlying causer layer unit a reduced diameter high aspect ratio tabular grain emulsion layer it is possible to improve the sharpness of the dye image produced in an underlying minus blue recording affected layer unit. Multicolor photographic elements satisfying the above requirement and thereby capable of realizing an improvement of sharpness in a minus blue recording affected layer unit can be illustrated by the following exemplary embodiments.

First, if it is assumed that only one each of blue, green, and red recording dye image providing layer units are present and that those layer units each contain a reduced diameter high aspect ratio tabular grain emulsion layer, the following six layer order arrangements are possible:

| Layer Unit Arrangement I |
|---|
| Exposure |
| TEB |
| TEG |
| TER |
| Layer Unit Arrangement II |
| Exposure |
| TEG |
| TER |
| TEB |
| Layer Unit Arrangement III |
| Exposure |
| TEG |
| TEB |
| TER |
| Layer Unit Arrangement IV |
| Exposure |
| TER |
| TEG |
| TEB |
| Layer Unit Arrangement V |
| Exposure |
| TEB |
| TER |
| TEG |
| Layer Unit Arrangement VI |
| Exposure |
| TER |
| TEB |
| TEG |

wherein

B, G, and R designate blue, green and red recording dye image providing layer units, respectively, and TE as a prefix designates the presence of a reduced diameter high aspect ratio tabular grain emulsion.

In Layer Unit Arrangements II and IV the reduced diameter high aspect ratio tabular grain emulsions in the central layer units, the red and green layer units, respectively, can have a mean diameter in the range of from 0.2 to 0.55 μm without detracting from image sharpness. This is because these central layer units each overlie only a blue recording layer unit. In Daubendiek et al U.S. Ser. No. 790,693, cited above, it has been shown that sharpness advantages over nontabular and lower aspect ratio tabular grain emulsions can be realized in the 0.2 to 0.55 μm mean diameter range for blue light exposures.

In Layer Unit Arrangements I through VI conventional nontabular or tabular grain emulsions can be substituted for the reduced diameter high aspect ratio tabular grain emulsions in the bottom layer units with only a small loss in sharpness, since these layer units do not overlie any other layer unit. Additionally or alternatively, in Layer Unit Arrangements I and V conventional nontabular or tabular grain emulsions can be substituted for the reduced diameter high aspect ratio tabular grain emulsions in the topmost, blue recording layer units. A somewhat higher impact on image sharpness will result, but advantages in sharpness can still be realized. Additionally or alternatively, in Layer Unit Arrangements II, III, IV, and VI conventional nontabular or tabular grain emulsions can be substituted for the reduced diameter high aspect ratio tabular grain emulsions in the centrally positioned layer units.

When Layer Unit Arrangements I through VI are modified with the cumulative substitutions above suggested to each contain only a single reduced diameter high aspect ratio tabular grain emulsion as required by the present invention, Layer Unit Arrangements VII through XII result:

| Layer Unit Arrangement VII Exposure |
|---|
| B |
| TEG |
| R |
| **Layer Unit Arrangement VIII Exposure** |
| TEG |
| R |
| B |
| **Layer Unit Arrangement IX Exposure** |
| TEG |
| B |
| R |
| **Layer Unit Arrangement X Exposure** |
| TER |
| G |
| B |
| **Layer Unit Arrangement XI Exposure** |
| B |
| TER |
| G |
| **Layer Unit Arrangement XII Exposure** |
| TER |
| B |
| G |

It is, of course, appreciated that while the multicolor photographic elements of this invention have been illustrated above by reference to multicolor photographic elements containing only one each of blue, green, and red recording layer units, in accordance with conventional practice, they can include more than one dye image providing layer unit intended to record exposures in the same third of the spectrum. For example, photographic elements which employ two or three each of blue, green, and red recording layer units are often encountered in the art. Typically the color forming layers which record the same third of the visible spectrum are chosen to differ in photographic speed, thereby extending the exposure latitude of the photographic element. Exemplary multicolor photographic elements containing two or more layer units intended to record exposures within the same third of the visible spectrum are illustrated by Eeles et al U.S. Pat. No. 4,186,876; Kofron et al U.S. Pat. No. 4,439,520; Ranz et al German OLS No. 2,704,797; and Lohman et al German OLS Nos. 2,622,923, 2,622,924, and 2,704,826. It is therefore apparent that a green or red recording layer unit may be positioned, directly or separated by intervening layers, beneath a green or red recording layer unit containing a reduced diameter high aspect ratio tabular grain emulsion and still benefit in terms of image sharpness.

The preferred multicolor photographic elements of this invention are those in which at least one of each of the blue, green, and red recording layer units is comprised of a reduced diameter high aspect ratio tabular grain emulsion layer. The further advantages of the invention are hereinafter described with specific reference to Layer Order Arrangements I through VI, which satisfy these criteria. The applicability of these advantages to more elaborate layer order arrangements can be readily appreciated. It is further appreciated that the sharpness advantages of the invention can be realized with rarely constructed multicolor photographic elements having only two superimposed silver halide emulsion layers.

The choice of reduced diameter high aspect ratio tabular grain emulsions for each of the blue, green, and red recording layer units minimizes the scatter by the silver bromide or bromoiodide grains of both blue and minus blue light, thereby contributing unexpectedly large improvements in image sharpness. Stated more generally, by choosing emulsions according to this invention for each of the overlying causer layer units, the image sharpness in each of the blue and minus blue recording underlying affected layer units is increased.

Turning to other photographic properties, it is to be noted additionally that the reduced diameter high aspect ratio tabular grain silver bromide and silver bromoiodide emulsions in the minus blue recording layer units exhibit larger differences between their minus blue and blue speeds than have heretofore been observed for conventional multicolor photographic elements of intermediate and lower camera speeds—that is, those of ISO exposure ratings of 180 or less.

As is generally recognized by those skilled in the art, silver bromide and silver bromoiodide emulsions possess native sensitivity to the blue portion of the spectrum. By adsorbing a spectral sensitizing dye to the silver bromide or bromoiodide grain surfaces the emulsions can be sensitized to the minus blue portion of the spectrum—that is, the green or red portion of the spectrum—for use in green or red recording dye image providing layer units. For such applications the retained native blue sensitivity of the emulsions is a liability, since recording both blue and minus blue light received on exposure degrades the integrity of the red or green exposure record that is desired. While a variety of techniques have been suggested for ameliorating blue contamination of the minus blue record, the most common approach is to locate blue recording dye image providing layer units above and minus blue recording dye image providing layer units beneath a yellow filter layer. The concomitant disadvantages are the requirement of an additional layer in the photographic element and the necessity of locating the minus blue recording layer units, which are more important to perceived image quality, in a disadvantageous location for producing the sharpest possible images.

The present invention makes possible minus blue recording dye image providing layer units which exhibit exceptionally large minus blue and blue speed separations by employing for the first time in intermediate camera speed photographic elements reduced diameter high aspect ratio tabular grain silver bromide and bromoiodide emulsions. Specifically, exceptionally high minus blue and blue speed separations can be attributed to employing emulsions of the 0.4 to 0.55 μm mean grain size range in which greater than 50 percent of the total grain projected area is accounted for by tabular grains having aspect ratios of greater than 8:1. To the extent that the aspect ratios and projected areas are increased to the preferred levels previously identified the minus blue to blue speed separations can be further enhanced.

In addition to the advantages above discussed, it is pointed out that the reduced diameter high aspect ratio tabular grain emulsions incorporated in the layer units make possible moderate camera speed photographic elements which exhibit lower granularity than can be achieved at comparable silver levels by emulsions heretofore employed in intermediate camera speed multicolor photographic elements. Lower granularities at comparable silver levels are made possible by the reduced diameters and high aspect ratios of the tabular grain emulsions employed. As mean grain diameters are reduced below 0.55 μm, additional improvements in granularity can be realized. Granularity can also be improved further as aspect ratio and tabular grain projected area are increased to the preferred levels previously identified.

It is additionally recognized that when reduced diameter high aspect ratio tabular grain emulsions are employed in the blue recording layer units a high efficiency of silver utilization and low granularities can be achieved while at the same time achieving photographic speeds that are desirably matched to those of the minus blue recording layer units. Whereas Kofron et al suggests increasing tabular grain thicknesses from 0.3 to 0.5 μm to increase the blue sensitivity of blue recording high aspect ratio tabular grain emulsions, the present invention in employing tabular grains of both high aspect ratio and reduced diameter necessarily requires the use of extremely thin tabular grains. For high aspect ratio tabular grains exhibiting equivalent circular diameters in the range of from 0.2 to 0.55 μm, it is apparent that the grain thicknesses must be less than from 0.025 to 0.07 μm to satisfy the greater than 8:1 aspect ratio requirement. To achieve adequate blue speeds these emulsions contain adsorbed to the grain surfaces a blue sensitizing dye, more specifically described below. If nontabular or lower aspect ratio tabular grains are substituted for the reduced diameter high aspect ratio tabular grains, the result is higher granularity at comparable silver coverages or higher silver coverages at comparable granularity.

The cumulative effect imparted by the reduced diameter high aspect ratio tabular grain emulsions is to make possible moderate camera speed photographic elements which exhibit exceptional properties in terms of image sharpness, integrity of the minus blue record, granularity, and silver utilization.

The dye image providing layer units each include a silver halide emulsion. At least one and preferably all of the layer units include a reduced diameter high aspect ratio tabular grain emulsion satisfying the grain characteristics previously described. To the extent other nontabular and tabular grain emulsions are employed in one or more of the dye image providing layer units of the photographic elements, such emulsions can take any desired conventional form, as illustrated by Kofron et al U.S. Pat. No. 4,439,520; House et al U.S. Pat. No. 4,490,458; and *Research Disclosure,* Vol. 176, January 1978, Item 17643, Section I, Emulsion preparation and types.

Vehicles (including both binders and peptizers) which form the dispersing media of the emulsions can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g., cellulose esters, gelatin—e.g., alkali-treated gelatin (cattle bone or hide gelatin), acid-treated gelatin (pigskin gelatin), or oxidizing agent-treated gelatin, gelatin derivatives—e.g., acetylated gelatin, phthalated gelatin, and the like, polysaccharides such as dextran, gum arabic, zein, casein, pectin, collagen derivatives, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787,545 and 2,956,880, Corben et al U.S. Pat. No. 2,890,215, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, Hori et al U.K. Pat. No. 1,489,080 and Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Komatsu et al Japanese Kokai Pat. No. Sho 58[1983]-70221, Fallesen U.S. Pat. No. 2,343,650, Yutzy U.S. Pat. No. 2,312,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Maskasky U.S. Ser. No. 811,133, filed Dec. 19, 1985, the teachings of which are here incorporated by reference, has recognized particular advantages for employing gelatino-peptizers containing less than 30 micromoles of methionine per gram in the precipitation of tabular grain silver bromide and silver bromoiodide emulsions. The number of nontabular grain shapes can be reduced, particularly in silver bromide emulsions, and in preparing silver bromoiodide emulsions the tendency of iodide to thicken the tabular grains can be diminished. The gelatino-peptizers present at nucleation of the tabular grains are preferably low methionine peptizers, as taught by Maskasky, but the benefits of low methionine gelatino-peptizers can also be realized when these peptizers are first introduced after nucleation and during tabular grain growth. Reduction of the methionine level in gelatino-peptizers can be achieved by treatment of the gelatin with an oxidizing agent. Specifically preferred gelatino-peptizers are those containing less than 5 micromoles of methionine per gram of gelatin. Gelatino-peptizers initially having higher levels of methionine can be treated with a suitable oxidizing agent, such as hydrogen peroxide, to reduce the methionine to the extent desired.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and '228, Wood U.K. Pat. No. 822,192 and Iguchi et al U.K. Pat. No. 1,398,055. These additional materials need not be present in the reaction vessel during silver bromide precipitation, but rather are conventionally added to the emulsion prior to coating.

The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers. The layers of the photographic elements containing crosslinkable colloids, particularly gelatin-containing layers, can be hardened by various organic or inorganic hardeners, such as those described by *Research Disclosure,* Item 17643, cited above, Section X.

Although not essential to the practice of the invention, as a practical matter the latent image forming grains of the image recording emulsion layers are chemically sensitized. Chemical sensitization can occur either before or after spectral sensitization. Techniques for chemically sensitizing latent image forming silver halide grains are generally known to those skilled in the art and are summarized in *Research Disclosure,* Item 17643, cited above, Section III. The tabular grain latent image forming emulsions can be chemically sensitized as taught by Maskasky U.S. Pat. No. 4,435,501 or Kofron et al U.S. Pat. No. 4,439,520.

It is essential to employ respectively in combination with the green and red recording emulsion layers one or more green and red spectral sensitizing dyes. While silver bromide and bromoiodide emulsions generally exhibit sufficient native sensitivity to blue light that they do not require the use of blue sensitizers, it is preferred to employ blue sensitizing dyes in combination with blue recording emulsion layers, particularly in combination with high aspect ratio tabular grain emulsions.

The silver halide emulsions can be spectrally sensitized with dyes from a variety of classes, including the polymethine dye class, which classes include the cyanines, merocyanines, complex cyanines and merocyanines (i.e., tri-, tetra-, and polynuclear cyanines and merocyanines), oxonols, hemioxonols, styryls, merostyryls, and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium, and imidazopyrazinium quaternary salts.

The merocyanine spectral sensitizing dyes include, joined by a methine linkage, a basic heterocyclic nucleus of the cyanine dye type and an acidic necleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering,* Vol. 18, 1974, pp. 418–430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al U.S. Pat. No. 2,131,038 and Shiba et al U.S. Pat. No. 3,930,860.

Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering,* Vol. 18, 1974, pp. 49–53 (Sturmer et al), pp. 175–178 (Leubner) and pp. 475–485 (Gilman). Oxidation and reduction potentials can be measured as described by R. F. Large in *Photographic Sensitivity,* Academic Press, 1973, Chapter 15.

The chemistry of cyanine and related dyes is illustrated by Weissberger and Taylor, *Special Topics of Heterocyclic Chemistry,* John Wiley and Sons, New York, 1977, Chapter VIII; Venkataraman, *The Chemistry of Synthetic Dyes,* Academic Press, New York, 1971, Chapter V; James, *The Theory of the Photographic Process,* 4th Ed., Macmillan, 1977, Chapter 8, and F. M. Hamer, *Cyanine Dyes and Related Compounds,* John Wiley and Sons, 1964.

Among useful spectral sensitizing dyes for sensitizing silver halide emulsions are those found in U.K. Pat. No. 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,231,658, 2,493,747, '748, 2,526,632, 2,739,964 (Re. 24,292), 2,778,823, 2,917,516, 3,352,857, 3,411,916 and 3,431,111, Wilmanns et al U.S. Pat. No. 2,295,276, Sprague U.S. Pat. Nos. 2,481,698 and 2,503,776, Carroll et al U.S. Pat. Nos. 2,688,545 and 2,704,714, Larive et al U.S. Pat. No. 2,921,067, Jones U.S. Pat. No. 2,945,763, Nys et al U.S. Pat. No. 3,282,933, Schwan et al U.S. Pat. No. 3,397,060, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470, Mee U.S. Pat. No. 4,025,349, and Kofron et al U.S. Pat. No. 4,439,520. Examples of useful dye combinations, including supersensitizing dye combinations, are found in Motter U.S. Pat. No. 3,506,443 and Schwan et al U.S. Pat. No. 3,672,898. As examples of supersensitizing combinations of spectral sensitizing dyes and non-light absorbing addenda, it is specifically contemplated to employ thiocyanates during spectral sensitization, as taught by Leermakers U.S. Pat. No. 2,221,805; bistriazinylaminostilbenes, as taught by McFall et al U.S. Pat. No. 2,933,390; sulfonated aromatic compounds, as taught by Jones et al U.S. Pat. No. 2,937,089; mercapto-substituted heterocycles, as taught by Riester U.S. Pat. No. 3,457,078; iodide, as taught by U.K. Specification No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular or low aspect ratio tabular silver halide grains. To realize the full advantages of this invention it is preferred to adsorb spectral sensitizing dye to the grain surfaces of the tabular grain emulsions in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.,* Vol 56, p. 1065, 1952; Spence et al, "Desensitization of Sensitizing Dyes", *Journal of Physical and Colloid Chemistry,* Vol. 56, No. 6, June 1948, pp. 1090–1103; and Gilman et al U.S. Pat. No. 3,979,213. Optimum dye concentration levels can be chosen by procedures taught by Mees, *Theory of the Photographic Process,* Macmillan, 1942, pp. 1067–1069.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by Philippaerts et al U.S. Pat. No. 3,628,960, and Locker et al U.S. Pat. No. 4,225,666. As taught by Locker et al, it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al, it is specifically contemplated that the spectral sensitizing dye can be added to the emulsion after 80 percent of the silver halide has been precipitated. Sensitization can be enhanced by pAg adjustment, including variation in pAg which completes one or more cycles, during chemical and/or spectral sensitization. A specific example of pAg adjustment is provided by *Research Disclosure,* Vol. 181, May 1979, Item 18155.

As taught by Kofron et al U.S. Pat. No. 4,439,520, high aspect ratio tabular grain silver halide emulsions can exhibit better speed-granularity relationships when chemically and spectrally sensitized than have heretofore been achieved using conventional silver halide emulsions of like halide content.

In one preferred form, spectral sensitizers can be incorporated in the tabular grain emulsions prior to chemical sensitization. Similar results have also been achieved in some instances by introducing other adsorbable materials, such as finish modifiers, into the emulsions prior to chemical sensitization.

Independent of the prior incorporation of adsorbable materials, it is preferred to employ thiocyanates during chemical sensitization in concentrations of from about $2\times10^{-3}$ to 2 mole percent, based on silver, as taught by Damschroder U.S. Pat. No. 2,642,361, cited above. Other ripening agents can be used during chemical sensitization.

In still a third approachd, which can be practiced in combination with one or both of the above approaches or separately thereof, it is preferred to adjust the concentration of silver and/or halide salts present immediately prior to or during chemical sensitization. Soluble silver salts, such as silver acetate, silver trifluoroacetate, and silver nitrate, can be introduced as well as silver salts capable of precipitating onto the grain surfaces, such as silver thiocyanate, silver phosphate, silver carbonate, and the like. Fine silver halide (i.e., silver bromide and/or chloride) grains capable of Ostwald ripening onto the tabular grain surfaces can be introduced. For example, a Lippmann emulsion can be introduced during chemical sensitization. Maskasky U.S. Pat. No. 4,435,501, discloses the chemical sensitization of spectrally sensitized high aspect ratio tabular grain emulsions at one or more ordered discrete sites of the tabular grains. It is believed that the preferential adsorption of spectral sensitizing dye on the crystallographic surfaces forming the major faces of the tabular grains allows chemical sensitization to occur selectively at unlike crystallographic surfaces of the tabular grains.

The preferred chemical sensitizers for the highest attained speed-granularity relationships are gold and sulfur sensitizers, gold and selenium sensitizers, and gold, sulfur, and selenium sensitizers. Thus, in a preferred form, the high aspect ratio tabular grain silver bromide and bromoiodide emulsions contain a middle chalcogen, such as sulfur and/or selenium, which may not be detectable, and gold, which is detectable. The emulsions also usually contain detectable levels of thiocyanate, although the concentrations of the thiocyanate in the final emulsions can be greatly reduced by known emulsion washing techniques. In various of the preferred forms indicated above the tabular silver bromide or bromoiodide grains can have another silver salt at their surface, such as silver thiocyanate or silver chloride, although the other silver salt may be present below detectable levels.

Although not required to realize all of their advantages, the image recording emulsions are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 (1−log E), where E is measured in meter-candle-seconds at a density of 0.1 above fog. Once the silver halide grains of an emulsion layer have been characterized, it is possible to estimate from further product analysis and performance evaluation whether an emulsion layer of a product appears to be substantially optimally chemically and spectrally sensitized in relation to comparable commercial offerings of other manufacturers.

In addition to the silver bromide or bromoiodide grains, spectral and chemical sensitizers, vehicles, and hardeners described above, the photographic elements can contain in the emulsion or other layers thereof brighteners, antifoggants, stabilizers, scattering or absorbing materials, coating aids, plasticizers, lubricants, and matting agents, as described in *Research Disclosure,* Item 17643, cited above, Sections V, VI, VII, XI, XII, and XVI. Methods of addition and coating and drying procedures can be employed, as described in Section XIV and XV. Conventional photographic supports can be employed, as described in Section XVII.

The dye image producing multicolor photographic elements of this invention need not incorporate dye image providing compounds as initially prepared, since processing techniques for introducing image dye providing compounds after imagewise exposure and during processing are well known in the art. However, to simplify processing it is common practice to incorporate image dye providing compounds in multicolor photographic elements prior to processing, and such multicolor photographic elements are specifically contemplated in the practice of this invention.

When dye image providing compounds are incorporated in the multicolor photographic elements as formed, at least one dye image providing compound is located in each layer unit. The incorporated dye image providing compound is chosen to provide a subtractive primary image dye which absorbs light in the same third of the spectrum the layer unit is intended to record. That is, the multicolor photographic element is made of at least one layer unit containing a blue recording emulsion layer and a yellow dye image providing compound, at least one layer unit containing a green recording emulsion layer and a magenta dye image providing compound, and at least one red recording layer unit containing a cyan dye image providing compound. The dye image providing compound in each layer unit can be located directly in the emulsion layer or in a separate layer adjacent the emulsion layer.

The multicolor photographic elements can form dye images through the selective destruction, formation, or physical removal of incorporated image dye providing compounds. The photographic elements described above for forming silver images can be used to form dye images by employing developers containing dye image formers, such as color couplers, as illustrated in U.K. Pat. No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. No. 2,343,703, 2,376,380 and 2,369,489, Spath U.K. Pat. No. 886,723 and U.S. Pat. No. 2,899,306, Tuite U.S. Pat. No. 3,152,896 and Mannes et al U.S. Pat. Nos. 2,115,394, 2,252,718 and 2,108,602, and Pilato U.S. Pat. No. 3,547,650. In this form the developer contains a color-developing agent (e.g., a primary aromatic amine) which in its oxidized form is capable of reacting with the coupler (coupling) to form the image dye.

The dye-forming couplers can be incorporated in the photographic elements, as illustrated by Schneider et al,

*Die Chemie,* Vol. 57, 1944, p. 113, Mannes et al U.S. Pat. No. 2,304,940, Martinez U.S. Pat. No. 2,269,158, Jelley et al U.S. Pat. No. 2,322,027, Frolich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435 and Chen *Research Disclosure,* Vol. 159, July 1977, Item 15930. The dye-forming couplers can be incorporated in different amounts to achieve differing photographic effects. For example, U.K. Pat. No. 923,045 and Kumai et al U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,137,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al U.K. Pat. No. 1,248,924 and Whitmore et al U.S. Pat. No. 3,227,550. Dye-forming couplers of differing reaction rates in single or separate layers can be employed to achieve desired effects for specific photographic applications.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Pat No. 1,201,110, Oishi et al U.S. Pat. No. 3,642,485, Verbrugghe U.K. Pat. No. 1,236,767, Fujiwhara et al U.S. Pat. No. 3,770,436 and Matsuo et al U.S. Pat. No. 3,808,945. Dye-forming couplers and nondye-forming compounds which upon coupling release a variety of photographically useful groups are described by Lau U.S. Pat. No. 4,248,962. DIR compounds which do not form dye upon reaction with oxidized color-developing agents can be employed, as illustrated by Fujiwhara et al German OLS No. 2,529,350 and U.S. Pat. Nos. 3,928,041, 3,958,993 and 3,961,959, Odenwalder et al German OLS No. 2,448,063, Tanaka et al German OLS No. 2,610,546, Kikuchi et al U.S. Pat. No. 4,049,455 and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129. Silver halide emulsions which are relatively light insensitive, such as Lippmann emulsions, have been utilized as interlayers and overcoat layers to prevent or control the migration of development inhibitor fragments as described in Shiba et al U.S. Pat. No. 3,892,572.

The photographic elements can incorporate colored dye-forming couplers, such as those employed to form integral masks for negative color images, as illustrated by Hanson U.S. Pat. No. 2,449,966, Glass et al U.S. Pat. No. 2,521,908, Gledhill et al U.S. Pat. No. 3,034,892, Loria U.S. Pat. No. 3,476,563, Lestina U.S. Pat. No. 3,519,429, Friedman U.S. Pat. No. 2,543,691, Puschel et al U.S. Pat. No. 3,028,238, Menzel et al U.S. Pat. No. 3,061,432 and Greenhalgh U.K. Pat. No. 1,035,959, and/or competing couplers, as illustrated by Murin et al U.S. Pat. No. 3,876,428, Sakamoto et al U.S. Pat. No. 3,580,722, Puschel U.S. Pat. No. 2,998,314, Whitmore U.S. Pat. No. 2,808,329, Salminen U.S. Pat. No. 2,742,832 and Weller et al U.S. Pat. No. 2,689,793.

The photographic elements can include image dye stabilizers. Such image dye stabilizers are illustrated by U.K. Pat. No. 1,326,889, Lestina et al U.S. Pat. Nos. 3,432,300 and 3,698,909, Stern et al U.S. Pat. No. 3,574,627, Brannock et al U.S. Pat. No. 3,573,050, Arai et al U.S. Pat. No. 3,764,337 and Smith et al U.S. Pat. No. 4,042,394.

Dye images can be formed or amplified by processes which employ in combination with a dye-image-generating reducing agent an inert transition metal ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent, as illustrated by Matejec U.S. Pat. No. 3,674,490, *Research Disclosure,* Vol. 116, December 1973, Item 11660, and Bissonette *Research Disclosure,* Vol. 148, August 1976, Items 14836, 14846 and 14847. The photographic elements can be particularly adapted to form dye images by such processes, as illustrated by Dunn et al U.S. Pat. No. 3,822,129, Bissonette U.S. Pat. Nos. 3,834,907 and 3,902,905, Bissonette et al U.S. Pat. No. 3,847,619 and Mowrey U.S. Pat. No. 3,904,413.

The photographic elements can produce dye images through the selective destruction of dyes or dye precursors, such as silver-dye-bleach processes, as illustrated by A. Meyer, *The Journal of Photographic Science,* Vol. 13, 1965, pp. 90–97. Bleachable azo, azoxy, xanthene, azine, phenylmethane, nitroso complex, indigo, quinone, nitro-substituted, phthalocyanine and formazan dyes, as illustrated by Stauner et al U.S. Pat. No. 3,754,923, Piller et al U.S. Pat. No. 3,749,576, Yoshida et al U.S. Pat. No. 3,738,839, Froelich et al U.S. Pat. No. 3,716,368, Piller U.S. Pat. No. 3,655,388, Williams et al U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al U.S. Pat. Nos. 3,202,511 and 3,178,291 and Anderau et al U.S. Pat. Nos. 3,178,285 and 3,178,290, as well as their hydrazo, diazonium and tetrazolium precursors and leuco and shifted derivatives, as illustrated by U.K. Pat. Nos. 923,265, 999,996 and 1,042,300, Pelz et al U.S. Pat. No. 3,684,513, Watanabe et al U.S. Pat. No. 3,615,493, Wilson et al U.S. Pat. No. 3,503,741, Boes et al U.S. Pat. No. 3,340,059, Gompf et al U.S. Pat. No. 3,493,372 and Puschel et al U.S. Pat. No. 3,561,970, can be employed.

To prevent migration of oxidized developing or electron transfer agents between layer units intended to record exposures in different regions of the spectrum—e.g., between blue and minus blue recording layer units or between green and red recording layer units—with resultant color degradation, it is common practice to employ scavengers. The scavengers can be located in the emulsion layers themselves and/or in interlayers between adjacent dye image providing layer units. Useful scavengers include those disclosed by Weissberger et al U.S. Pat. No. 2,336,327; Yutzy et al U.S. Pat. No. 2,937,086; Thirtle et al U.S. Pat. No. 2,701,197; and Erikson et al U.S. Pat. No. 4,205,987.

The photographic elements can be processed to form dye images which correspond to or are reversals of the silver halide rendered selectively developable by imagewise exposure. Reversal dye images can be formed in photographic elements having differentially spectrally sensitized silver halide layers by black-and-white development followed by (i) where the elements lack incorporated dye image formers, sequential reversal color development with developers containing dye image formers, such as color couplers, as illustrated by Mannes et al U.S. Pat. No. 2,252,718, Schwan et al U.S. Pat. No. 2,950,970 and Pilato U.S. Pat. No. 3,547,650; (ii) where the elements contain incorporated dye image formers, such as color couplers, a single color development step, as illustrated by the Kodak Ektachrome E4 and E6 and Agfa processes described in *British Journal of Photography Annual,* 1977, pp. 194–197, and *British Journal of Photography,* Aug. 2, 1974, pp. 668–669; and (iii) where the photographic elements contain bleachable dyes, silver-dye-bleach processing, as illustrated by the Cibachrome P-10 and P-18 processes described in the *British Journal of Photography Annual,* 1977, pp. 209–212.

The photographic elements can be adapted for direct color reversal processing (i.e., production of reversal color images without prior black-and-white development), as illustrated by U.K. Pat. No. 1,075,385, Barr U.S. Pat. No. 3,243,294, Hendess et al U.S. Pat. No. 3,647,452, Puschel et al German Pat. No. 1,257,570 and U.S. Pat. Nos. 3,457,077 and 3,467,520, Accary-Venet et al U.K. Pat. No. 1,132,736, Schranz et al German Pat. No. 1,259,700, Marx et al German Pat. No. 1,259,701 and Muller-Bore German OLS No. 2,005,091.

Dye images which correspond to the grains rendered selectively developable by imagewise exposure, typically negative dye images, can be produced by processing, as illustrated by the Kodacolor C-22, the Kodak Flexicolor C-41 and the Agfacolor processes described in *British Journal of Photography Annual,* 1977, pp. 201–205. The photographic elements can also be processed by the Kodak Ektaprint-3 and -300 processes as described in Kodak Color Dataguide, 5th Ed., 1975, pp. 18–19, and the Agfa color process as described in *British Journal of Photography Annual,* 1977, pp. 205–206, such processes being particularly suited to processing color print materials, such as resin-coated photographic papers, to form positive dye images.

The invention is further illustrated by the following examples:

EXAMPLE 1

Preparation of Reduced Diameter High Aspect Ratio Tabular Grain Emulsions

This example has as its purpose to illustrate specific preparations of reduced diameter high aspect ratio tabular grain emulsions satisfying the requirements of this invention.

EXAMPLE EMULSION A

To a reaction vessel equipped with efficient stirring was added 3.0 L of a solution containing 7.5 g of bone gelatin. The solution also contained 0.7 mL of antifoaming agent. The pH was adjusted to 1.94 at 35° C. with $H_2SO_4$ and the pAg to 9.53 by addition of an aqueous solution of potassium bromide. To the vessel was simultaneously added over a period of 12 s a 1.25M solution of $AgNO_3$ and a 1.25M solution of KBr+KI (94:6 mole ratio) at a constant rate, consuming 0.02 moles Ag. The temperature was raised to 60° C. (5° C./3 min) and 66 g of bone gelatin in 400 mL of water was added. The pH was adjusted to 6.00 at 60° C. with NaOH, and the pAg to 8.88 at 60° C. with KBr. Using a constant flow rate, the precipitation was continued with the addition of a 0.4M $AgNO_3$ solution over a period of 24.9 min. Concurrently at the same rate was added a 0.0121M suspension of an AgI emulsion (about 0.05 μm grain size; 40 g/Ag mole bone gelatin). A 0.4M KBr solution was also simultaneously added at the rate required to maintain the pAg at 8.88 during the precipitation. The $AgNO_3$ provided a total of 1.0 mole Ag in this step of the precipitation, with an additional 0.03 mole Ag being supplied by the AgI emulsion. The emulsion was coagulation washed by the procedure of Yutzy, et al., U.S. Pat. No. 2,614,929.

The equivalent circular diameter of the mean projected area of the grains as measured on scanning electron micrographs using a Zeiss MOP III Image Analyzer was found to be 0.5 μm. The average thickness, by measurement of the micrographs, was found to be 0.038 μm, resulting in an aspect ratio of approximately 13:1. Tabular grains accounted for greater than 70 percent of the total grain projected area.

EXAMPLE EMULSION B

Emulsion B was prepared similarly as Emulsion A, the principal difference being that the bone gelatin employed was prepared for use in the following manner: To 500 g of 12 percent deionized bone gelatin was added 0.6 g of 30 percent $H_2O_2$ in 10 mL of distilled water. The mixture was stirred for 16 hours at 40° C., then cooled and stored for use.

To a reaction vessel equipped with efficient stirring was added 3.0 L of a solution containing 7.5 g of bone gelatin. The solution also contained 0.7 mL of an antifoaming agent. The pH was adjusted to 1.96 at 35° C. with $H_2SO_4$ and the pAg to 9.53 by addition of an aqueous solution of potassium bromide. To the vessel was simultaneously added over a period of 12 s a 1.25M solution of $AgNO_3$ and a 1.25M solution of KBr+KI (94:6 mole ratio) at a constant rate, consuming 0.02 moles Ag. The temperature was raised to 60° C. (5° C./3 min) and 70 g of bone gelatin in 500 mL of water was added. The pH was adjusted to 6.00 at 60° C. with NaOH, and the pAg to 8.88 at 60° C. with KBr. Using a constant flow rate, the precipitation was continued with the addition of a 1.2M $AgNO_3$ solution over a period of 17 min. Concurrently at the same rate was added a 0.04M suspension of an AgI emulsion (about 0.05 μm grain size; 40 g/Ag mole bone gelatin). A 1.2M KBr solution was also simultaneously added at the rate required to maintain the pAg at 8.88 during the precipitation. The $AgNO_3$ provided a total of 0.68 mole Ag in this step of the precipitation, with an additional 0.02 mole Ag being supplied by the AgI emulsion. The emulsion was coagulation washed by the procedure of Yutzy, et al., U.S. Pat. No. 2,614,929.

The equivalent circular diameter of the mean projected area of the grains as measured on scanning electron micrographs using a Zeiss MOP III Image Analyzer was found to be 0.43 μm. The average thickness, by measurement of the micrographs, was found to be 0.024 μm, resulting in an aspect ratio of approximately 17:1. Tabular grains accounted for greater than 70 percent of the total grain projected area.

EXAMPLES 2 THROUGH 37

Comparisons of Turbidity of Varied Causer Layer Units

In these examples the light scattering (turbidity) of coatings of a number of tabular grain emulsions, including reduced diameter high aspect ratio tabular grain emulsions and tabular grain emulsions failing to satisfsy these criteria either in terms of diameter or aspect ratio, are compared with conventional nontabular emulsions of varied grain shapes.

Table I lists the properties of the conventional nontabular (cubic, octahedral, monodisperse multiply twinned, and polydisperse multiply twinned) comparison emulsions as well as a number of tabular grain emulsions including reduced diameter high aspect ratio tabular grain emulsions satisfying the causer layer unit requirements of the invention, high aspect ratio tabular grain emulsions of both larger and smaller mean diameters, and an intermediate aspect ratio tabular grain emulsion of smaller mean diameter. In the high aspect ratio tabular grain emulsions the grains having an aspect ratio of greater than 8:1 accounted for from 70 to 90 percent of the total grain projected area, and in the intermediate aspect ratio tabular grain emulsion the tabular grains having an aspect ratio of greater than 5:1 fell in this same projected area range. The equivalent circular diameter (ECD) of the mean projected area of the grains was measured on scanning electron micrographs (SEM's) using a Zeiss MOP III ® image analyzer. Tabular grain thicknesses were determined from tabular grains which were on edge (viewed in a direction parallel to their major faces) in the SEM's.

The comparison and invention emulsions were coated at either 0.27 g/m² Ag or 0.81 g/m² Ag on a cellulose acetate support. All coatings were made with 3.23 g/m² gelatin. In addition, coatings of the reduced diameter high aspect ratio tabular grain emulsions were made at Ag levels to provide the same number of grains per unit area as would be obtained in the coatings of cubic or octahedral comparison emulsions of the same mean diameters when the latter were coated at 0.81 g/m² Ag, as calculated from the dimensions of the grains.

Turbidity or scatter of the coatings was determined using a Cary Model 14 spectrophotometer at 550 and 650 nm. The turbidity of the nontabular emulsions was plotted against ECD to provide a curve for comparison of the tabular grain emulsion turbidity at the mean ECD of the tabular grain emulsion. Turbidity differences were determined by reference to specular density (Dspec) and also by reference to a Q factor, which is the quotient of specular density divided by diffuse density. Specular density was measured as taught by Berry, *Journal of the Optical Society,* Vol. 52, No. 8, August 1962, pp. 888–895, cited above. Diffuse density was measured using an integrating sphere as taught by Kofron et al U.S. Pat. No. 4,439,520. For both measurements the tabular grain emulsions were superior in being less light scattering than the nontabular emulsions. The larger the differences reported between the nontabular and tabular grain emulsions, the greater the advantage in terms of sharpness advantages of the tabular grain emulsion compared.

TABLE I

| | Emulsion Properties | | | | |
|---|---|---|---|---|---|
| Emulsion No. | Grain Morphology | Iodide Mole %- | ECD m | Thickness m | Aspect Ratio |
| NT1 | Regular Cubic | 2.5 | .355 | — | — |
| NT2 | Regular Cubic | 3 | .245 | — | — |
| NT3 | Regular Cubic | 3 | .189 | — | — |
| NT4 | Regular Octahedral | 3 | .678 | — | — |
| NT5 | Regular Octahedral | 5 | .551 | — | — |
| NT6 | Regular Octahedral | 5 | .456 | — | — |
| NT7 | Regular Octahedral | 5 | .325 | — | — |
| NT8 | Regular Octahedral | 5 | .245 | — | — |
| NT9 | Monodisperse Multiply Twinned | 6 | .609 | — | — |
| NT10 | Monodisperse Multiply Twinned | 6 | .486 | — | — |
| NT11 | Monodisperse Multiply Twinned | 6 | .393 | — | — |
| NT12 | Monodisperse Multiply Twinned | 6 | .294 | — | — |
| NT13 | Polydisperse Multiply Twinned | 3 | .693 | — | — |
| NT14 | Polydisperse Multiply Twinned | 6.4 | .527 | — | — |
| NT15 | Polydisperse Multiply Twinned | 4.8 | .318 | — | — |
| TC16 | Tabular | 3 | .32 | .06 | 5.5:1 |
| TC17 | Tabular | 3 | .64 | .043 | 14:1 |
| TE18 | Tabular | 3 | .55 | .037 | 14:1 |
| TE19 | Tabular | 3 | .52 | .032 | 15:1 |
| TE20 | Tabular | 3 | .43 | .024 | 17:1 |
| TC21 | Tabular | 3 | .37 | .037 | 10:1 |
| TC22 | Tabular | 3 | .24 | .017 | 14:1 |

NT as a prefix designates nontabular comparative emulsions
TC as a prefix designates tabular comparative emulsions
TE as a prefix designates tabular example emulsions

EXAMPLES 2 THROUGH 4

Dspec Comparisons at 550 nm and Ag Coverage of 0.27 g/m²

The light scattering advantages of the tabular grain emulsions as compared to the nontabular emulsions wherein all emulsions were coated at silver coverages of 0.27 g/m² are reported in Table II. Scattering is measured in terms of Dspec at 550 nm.

TABLE II

| Emulsion No. | Δ Dspec |
|---|---|
| TC17 | 0.14 |
| TE18 | 0.20 |
| TE19 | 0.25 |
| TE20 | 0.28 |
| TC21 | 0.21 |
| TC22 | 0.13 |

From Table II it is apparent that the reduced diameter high aspect ratio tabular grain emulsions, which exhibit mean diameters in the range of from 0.4 to 0.55 μm, produce greater reductions in turbidity than tabular grain emulsions of either larger or smaller mean diameters when compared to nontabular emulsions of like mean diameters.

EXAMPLES 5 THROUGH 7

Q Factor Comparisons at 550 nm and Ag Coverage of 0.27 g/m$^2$

The light scattering advantages of the tabular grain emulsions as compared to the nontabular emulsions wherein all emulsions were coated at silver coverages of 0.27 g/m$^2$ are reported in Table III. Scattering is measured in terms of Q factors at 550 nm.

TABLE III

| Emulsion No. | Δ Q Factor |
|---|---|
| TC16 | 0.19 |
| TC17 | 0.28 |
| TE18 | 0.43 |
| TE19 | 0.47 |
| TE20 | 0.47 |
| TC21 | 0.37 |
| TC22 | 0.23 |

From Table III it is apparent that the reduced diameter high aspect ratio tabular grain emulsions, which exhibit mean diameters in the range of from 0.4 to 0.55 μm, produce greater reductions in turbidity than tabular grain emulsions of either larger or smaller mean diameters when compared to nontabular emulsions of like mean diameters.

EXAMPLES 8 THROUGH 10

Dspec Comparisons at 650 nm and Ag Coverage of 0.27 g/m$^2$

The light scattering advantages of the tabular grain emulsions as compared to the nontabular emulsions wherein all emulsions were coated at silver coverages of 0.27 g/m$^2$ are reported in Table IV. Scattering is measured in terms of Dspec at 650 nm.

TABLE IV

| Emulsion No. | Δ Dspec |
|---|---|
| TC17 | 0.19 |
| TE18 | 0.21 |
| TE19 | 0.23 |
| TE20 | 0.24 |
| TC21 | 0.16 |
| TC22 | 0.08 |

From Table IV it is apparent that the reduced diameter high aspect ratio tabular grain emulsions, which exhibit mean diameters in the range of from 0.4 to 0.55 μm, produce greater reductions in turbidity than tabular grain emulsions of either larger or smaller mean diameters when each are compared to nontabular emulsions of like mean diameters.

EXAMPLES 11 THROUGH 13

Q Factor Comparisons at 650 nm and Ag Coverage of 0.27 g/m$^2$

The light scattering advantages of the tabular grain emulsions as compared to the nontabular emulsions wherein all emulsions were coated at silver coverages of 0.27 g/m$^2$ are reported in Table V. Scattering is measured in terms of Q factors at 650 nm.

TABLE V

| Emulsion No. | Δ Q Factor |
|---|---|
| TC16 | 0.40 |
| TC17 | 0.49 |
| TE18 | 0.46 |
| TE19 | 0.46 |
| TE20 | 0.38 |
| TC21 | 0.38 |
| TC22 | 0.12 |

From Table V it is apparent that the reduced diameter high aspect ratio tabular grain emulsions, which exhibit mean diameters in the range of from 0.4 to 0.55 μm, produce greater reductions in turbidity than tabular grain emulsions of either larger or smaller mean diameters when each are compared to nontabular emulsions of like mean diameters, except that in this instance the tabular grain emulsion TC17, which has a mean diameter of 0.64 μm, produced a turbidity improvement comparable to that of the reduced diameter high aspect ratio tabular grain emulsions. However, it should be noted from Table IV that in Dspec measurements comparable improvements in turbidity were not observed. Further, in using Dspec and Q factor measurements at 550 nm comparable improvements in turbidity were not observed for comparison emulsion TC17.

EXAMPLES 14 THROUGH 16

Dspec Comparisons at 550 nm and Ag Coverage of 0.81 g/m$^2$

The light scattering advantages of the tabular grain emulsions as compared to the nontabular emulsions wherein all emulsions were coated at silver coverages of 0.81 g/m$^2$ are reported in Table VI. Scattering is measured in terms of Dspec at 550 nm.

TABLE VI

| Emulsion No. | Δ Dspec |
|---|---|
| TC17 | 0.62 |
| TE18 | 0.77 |
| TE19 | 0.85 |
| TE20 | 0.89 |
| TC21 | 0.65 |
| TC22 | 0.35 |

From Table VI it is apparent that the reduced diameter high aspect ratio tabular grain emulsions, which exhibit mean diameters in the range of from 0.4 to 0.55 μm, produce greater reductions in turbidity than tabular grain emulsions of either larger or smaller mean diameters when compared to nontabular emulsions of like mean diameters.

EXAMPLES 17 THROUGH 19

Dspec Comparisons at 550 nm and Matched Grain Coverages

The purpose of these examples was to provide turbidity comparisons of nontabular and tabular grain emulsions at silver coverages capable of yielding essentially similar levels of granularity.

The light scattering advantages of the tabular grain emulsions as compared to the nontabular emulsions wherein the emulsions are compared at coverages that provide equal numbers of grains per unit area are reported in Table VII. The nontabular emulsions were coated at silver coverages of 0.81 g/m$^2$. The tabular grain emulsions were each coated at a coverage calculated to provide the same number of grains per unit area as would be provided by octahedra of same mean ECD at a silver coverage of 0.81 g/m$^2$. Scattering is measured in terms of Dspec at 550 nm.

TABLE VII

| Emulsion No. | Δ Dspec |
|---|---|
| TC17 | 1.10 |
| TE18 | 1.26 |
| TE19 | 1.28 |
| TE20 | 1.26 |
| TC21 | 1.08 |
| TC22 | 0.66 |

From Table VII it is apparent that at coating coverages matching numbers of grains per unit area the reduced diameter high aspect ratio tabular grain emulsions, which exhibit mean diameters in the range of from 0.4 to 0.55 μm, produce greater reductions in turbidity than tabular grain emulsions of either larger or smaller mean diameters when compared to nontabular emulsions of like mean diameters.

When the tabular grain emulsion coverages were calculated assuming regular cubes instead of regular octahedra, essentially similar results were obtained, except that a slightly greater advantage for tabular grains was observed.

EXAMPLES 20 THROUGH 22

Q Factor Comparisons at 550 nm and Ag Coverage of 0.81 g/m$^2$

The light scattering advantages of the tabular grain emulsions as compared to the nontabular emulsions wherein all emulsions were coated at silver coverages of 0.81 g/m$^2$ are reported in Table VIII. Scattering is measured in terms of Q factor at 550 nm.

TABLE VIII

| Emulsion No. | Δ Q Factor |
|---|---|
| TC17 | 0.50 |
| TE18 | 0.61 |
| TE19 | 0.65 |
| TE20 | 0.68 |
| TC21 | 0.47 |
| TC22 | 0.18 |

From Table VIII it is apparent that the reduced diameter high aspect ratio tabular grain emulsions, which exhibit mean diameters in the range of from 0.4 to 0.55 μm, produce greater reductions in turbidity than tabular grain emulsions of either larger or smaller mean diameters when compared to nontabular emulsions of like mean diameters.

EXAMPLES 23 THROUGH 25

Q Factor Comparisons at 550 nm and Matched Grain Coverages

The purpose of these examples was to provide turbidity comparisons of nontabular and tabular grain emulsions at silver coverages capable of yielding essentially similar levels of granularity.

The light scattering advantages of the tabular grain emulsions as compared to the nontabular emulsions wherein the emulsions are compared at coverages that provide equal numbers of grains per unit area are reported in Table IX. The nontabular emulsions were coated at silver coverages of 0.81 g/m$^2$. The tabular grain emulsions were each coated at a coverage calculated to provide the same number of grains per unit area as would be provided by octahedra of same mean ECD at a silver coverage of 0.81 g/m$^2$. Scattering is measured in terms of Q factor at 550 nm.

TABLE IX

| Emulsion No. | Δ Q Factor |
|---|---|
| TC17 | 0.66 |
| TE18 | 0.75 |
| TE19 | 0.79 |
| TE20 | 0.74 |
| TC21 | 0.60 |
| TC22 | 0.29 |

From Table IX it is apparent that at coating coverages matching numbers of grains per unit area the reduced diameter high aspect ratio tabular grain emulsions, which exhibit mean diameters in the range of from 0.4 to 0.55 μm, produce greater reductions in turbidity than tabular grain emulsions of either larger or smaller mean diameters when compared to nontabular emulsions of like mean diameters.

When the tabular grain emulsion coverages were calculated assuming regular cubes instead of regular octahedra, essentially similar results were obtained, except that a slightly greater advantage for tabular grains was observed.

EXAMPLES 26 THROUGH 28

Dspec Comparisons at 650 nm and Ag Coverage of 0.81 g/m$^2$

The light scattering advantages of the tabular grain emulsions as compared to the nontabular emulsions wherein all emulsions were coated at silver coverages of 0.81 g/m$^2$ are reported in Table X. Scattering is measured in terms of Dspec at 650 nm.

TABLE X

| Emulsion No. | Δ Dspec |
|---|---|
| TC17 | 0.69 |
| TE18 | 0.70 |
| TE19 | 0.73 |
| TE20 | 0.68 |
| TC21 | 0.43 |
| TC22 | 0.15 |

From Table X it is apparent that the reduced diameter high aspect ratio tabular grain emulsions, which exhibit mean diameters in the range of from 0.4 to 0.55 μm, produce greater reductions in turbidity than tabular grain emulsions of either larger or smaller mean diameters when compared to nontabular emulsions of like mean diameters.

EXAMPLES 29 THROUGH 31

Dspec Comparisons at 650 nm and Matched Grain Coverages

The purpose of these examples was to provide turbidity comparisons of nontabular and tabular grain emulsions at silver coverages capable of yielding essentially similar levels of granularity.

The light scattering advantages of the tabular grain emulsions as compared to the nontabular emulsions wherein the emulsions are compared at coverages that provide equal numbers of grains per unit area are reported in Table XI. The nontabular emulsions were coated at silver coverages of 0.81 g/m$^2$. The tabular grain emulsions were each coated at a coverage calculated to provide the same number of grains per unit area as would be provided by octahedra of same mean ECD at a silver coverage of 0.81 g/m$^2$. Scattering is measured in terms of Dspec at 650 nm.

TABLE XI

| Emulsion No. | Δ Dspec |
|---|---|
| TC17 | 1.03 |
| TE18 | 1.04 |
| TE19 | 1.03 |
| TE20 | 0.91 |
| TC21 | 0.73 |
| TC22 | 0.38 |

From Table XI it is apparent that at coating coverages matching numbers of grains per unit area the reduced diameter high aspect ratio tabular grain emulsions, which exhibit mean diameters in the range of from 0.4 to 0.55 μm, produce greater reductions in turbidity than tabular grain emulsions of smaller mean diameters when compared to nontabular emulsions of like mean diameters.

When the tabular grain emulsion coverages were calculated assuming regular cubes instead of regular octahedra, essentially similar results were obtained, except that a slightly greater advantage for tabular grains was observed.

EXAMPLES 32 THROUGH 34

Q Factor Comparisons at 650 nm and Ag Coverage of 0.81 g/m$^2$

The light scattering advantages of the tabular grain emulsions as compared to the nontabular emulsions wherein all emulsions were coated at silver coverages of 0.81 g/m$^2$ are reported in Table XII. Scattering is measured in terms of Q factor at 650 nm.

TABLE XII

| Emulsion No. | Δ Q Factor |
|---|---|
| TC17 | 0.71 |
| TE18 | 0.61 |
| TE19 | 0.60 |
| TE20 | 0.55 |
| TC21 | 0.33 |
| TC22 | 0.13 |

From Table XII it is apparent that the reduced diameter high aspect ratio tabular grain emulsions, which exhibit mean diameters in the range of from 0.4 to 0.55 μm, produce greater reductions in turbidity than tabular grain emulsions of smaller mean diameters when compared to nontabular emulsions of like mean diameters.

EXAMPLES 35 THROUGH 37

Q Factor Comparisons at 650 nm and Matched Grain Coverages

The purpose of these examples was to provide turbidity comparisons of nontabular and tabular grain emulsions at silver coverages capable of yielding essentially similar levels of granularity.

The light scattering advantages of the tabular grain emulsions as compared to the nontabular emulsions wherein the emulsions are compared at coverages that provide equal numbers of grains per unit area are reported in Table XIII. The nontabular emulsions were coated at silver coverages of 0.81 g/m$^2$. The tabular grain emulsions were each coated at a coverage calculated to provide the same number of grains per unit area as would be provided by octahedra of same mean ECD at a silver coverage of 0.81 g/m$^2$. Scattering is measured in terms of Q factor at 650 nm.

TABLE XIII

| Emulsion No. | Δ Q Factor |
|---|---|
| TC17 | 0.83 |
| TE18 | 0.70 |
| TE19 | 0.74 |
| TE20 | 0.73 |
| TC21 | 0.60 |
| TC22 | 0.21 |

From Table XIII it is apparent that at coating coverages mathcing numbers of grains per unit area the reduced diameter high aspect ratio tabular grain emulsions, which exhibit mean diameters in the range of from 0.4 to 0.55 μm, produce greater reductions in turbidity than tabular grain emulsions of smaller mean diameters when compared to nontabular emulsions of like mean diameters.

When the tabular grain emulsion coverages were calculated assuming regular cubes instead of regular octahedra, essentially similar results were obtained, except that a slightly greater advantage for tabular grains was observed.

The invention has been described in detail with particular reference to preferred embodiments thereof, but it will be understood that variations and modifications can be effected within the spirit and scope of the invention.

What is claimed is:

1. A photographic element for producing multicolor dye images comprised of a support, and, coated on said support, superimposed dye image providing layer units comprised of at least one blue recording yellow dye image providing layer unit and at least two minus blue recording layer units including a green recording magenta dye image providing layer unit and a red recording cyan dye image providing layer unit, one of said layer units being positioned to receive imagewise exposing radiation prior to at least one of said minus blue recording layer units and containing a tabular grain emulsion comprised of a dispersing medium and silver bromide or bromoiodide grains having a mean diameter in the range of from 0.4 to 0.55 μm including tabular grains having an average aspect ratio of greater than 8:1 accounting for at least 50 percent of the total projected area of said grains in said emulsion layer.

2. A multicolor photographic element according to claim 1 in which said tabular grain emulsion is located in said blue recording layer unit.

3. A multicolor photographic element according to claim 1 in which said tabular grain emulsion is located in said green recording layer unit.

4. A multicolor photographic element according to claim 1 in which said tabular grain emulsion is located in said red recording layer unit.

5. A multicolor photographic element according to claim 1 in which each of said dye image providing layer units includes an incorporated dye image providing compound.

6. A multicolor photographic element according to claim 1 in which said tabular grain emulsion contains tabular grains having an aspect ratio greater than 8:1 accounting for at least 70 percent of the projected area of grains present in said emulsion.

7. A multicolor photographic element according to claim 1 in which said tabular grain emulsion contains tabular grains having an aspect ratio of at least 12:1 accounting for at least 50 percent of the total projected area of grains present in said emulsion.

8. A multicolor photographic element according to claim 1 in which each of said blue, green, and red recording dye image providing layer units contain a tabular grain emulsion comprised of a dispersing medium and silver bromide or bromoiodide grains having a mean diameter in the range of from 0.4 to 0.55 μm including tabular grains having an average aspect ratio of greater than 8:1 accounting for at least 50 percent of the total projected area of said grains in said tabular emulsion.

9. A multicolor photographic element according to claim 1 in which said tabular grain emulsion is a silver bromoiodide emulsion.

10. An intermediate camera speed photographic element for producing a multicolor dye image comprised of in the sequence recited a support and, coated on said support, at least one red recording layer unit containing a cyan dye forming coupler, at least one green recording layer unit containing a magenta dye forming coupler, and at least one blue recording layer unit containing a yellow dye forming coupler, each of said layer units containing a tabular grain emulsion comprised of a dispersing medium and silver bromoiodide grains having a mean diameter in the range of from 0.4 to 0.55 μm including tabular grains having an aspect ratio of at least 12:1 accounting for at least 50 percent of the total projected area of said grains in said emulsion.

* * * * *